US005727934A

United States Patent [19]

Sekita et al.

[11] Patent Number: 5,727,934

[45] Date of Patent: Mar. 17, 1998

[54] SCROLL TYPE FLUID MACHINE HAVING A THIN PLATE FOR EACH SCROLL

[75] Inventors: Masumi Sekita; Makoto Takeuchi; Yasuharu Maruiwa; Tetsuo Shigeoka, all of Nagoya; Tetsuzo Ukai; Mikihiko Ishii, both of Nishi-Kasugai-gun, all of Japan

[73] Assignee: Mitsubishi Jukogyo Kabushiki Kaisha, Tokyo, Japan

[21] Appl. No.: 723,922

[22] Filed: Oct. 1, 1996

[30] Foreign Application Priority Data

Oct. 30, 1995 [JP] Japan ..... 7-281394
Dec. 13, 1995 [JP] Japan ..... 7-324357

[51] Int. Cl.[6] ..... F01C 1/04; F01C 19/00

[52] U.S. Cl. ..... 418/55.2; 418/178

[58] Field of Search ..... 418/55.2, 178

[56] References Cited

U.S. PATENT DOCUMENTS

| | | | |
|---|---|---|---|
| 4,490,102 | 12/1984 | Carre et al. | 418/178 |
| 4,540,355 | 9/1985 | Sakaki et al. | 418/55.2 |
| 4,579,512 | 4/1986 | Shiibayashi et al. | 418/55.2 |
| 4,927,341 | 5/1990 | Bush | 418/55.2 |

FOREIGN PATENT DOCUMENTS

| | | | |
|---|---|---|---|
| 0178392 | 4/1986 | European Pat. Off. | 418/178 |
| 54-157315 | 12/1979 | Japan | 418/55.2 |
| 5535155 | 3/1980 | Japan | 418/55.2 |
| 58-135393 | 8/1983 | Japan . | |
| 60-75697 | 5/1987 | Japan . | |
| 1182589 | 7/1989 | Japan | 418/55.2 |
| 1-22953 | 8/1989 | Japan . | |
| 2-11881 | 1/1990 | Japan | 418/55.2 |
| 2149785 | 6/1990 | Japan | 418/55.2 |
| 4-71788 | 6/1992 | Japan . | |
| 4-95601 | 6/1992 | Japan . | |
| 5-26186 | 2/1993 | Japan . | |

*Primary Examiner*—John J. Vrablik
*Attorney, Agent, or Firm*—Wenderoth, Lind & Ponack

[57] ABSTRACT

A scroll fluid machine has a stationary scroll having a first end plate and a first spiral wrap projecting from one side of the first end plate. The first spiral wrap has a tip end. A swivel scroll has a second end plate and a second spiral wrap that projects from the one side of the second end plate. The second spiral wrap has a second end tip, and the first and second spiral wraps are engaged with each other. A first thin steel plate is provided on one side of the end plate between the first end plate and the second tip end. A first thin steel plate has a surface side that faces the second tip end. Further, a second thin steel plate is on one side of the second end plate between the second end plate and the first tip end. The second thin steel plate has a surface side that faces the first tip end. Both of the first and second thin steel plates are provided with conformable layers on the surfaces facing the tip ends. The conformable layers comprise a material that is softer than the first and second tip ends so that during operation a gap between the center portion of the tip ends and the opposite scroll end plate does not become too large. A leakage passage is provided in at least one of the thin plates so as to interconnect a central compression chamber formed by the spiral wraps and the outer circumferential chambers.

12 Claims, 9 Drawing Sheets

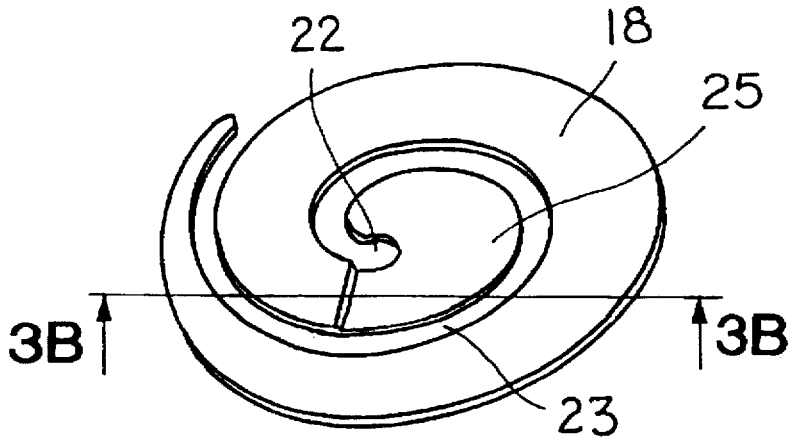
FIG. 3A
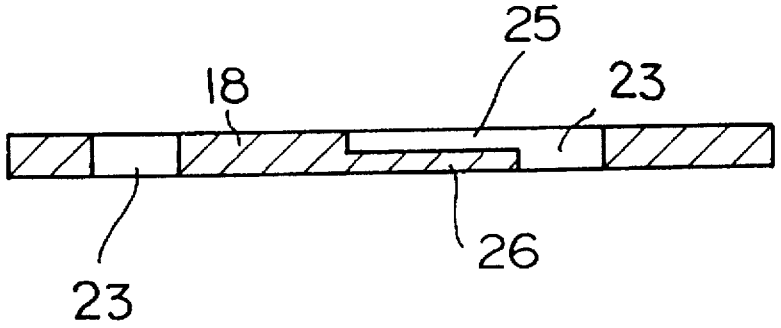
FIG. 3B
FIG. 4
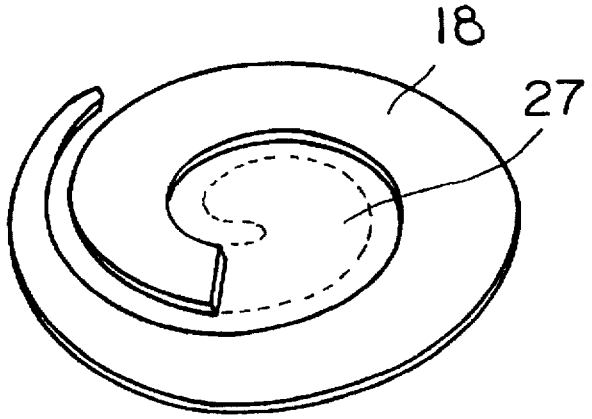

SCROLL TYPE FLUID MACHINE HAVING A THIN PLATE FOR EACH SCROLL

BACKGROUND OF THE INVENTION

1. Field of the Invention

The present invention relates to a scroll type fluid machine.

2. Description of the Prior Art

FIG. 9 is a longitudinal sectional view of a scroll type compressor in the prior art. In FIG. 9, numeral 3 designates a housing, numeral 4 designates a discharge cover for partitioning the inside of the housing 3 to an upper high pressure side and a lower low pressure side, numeral 1 designates a stationary scroll provided in the upper portion of the low pressure side, numeral 2 designates a swivel scroll engaged with the stationary scroll 1, numerals 8 and 9 designate bearings, numeral 7 designates a rotational shaft supported by the bearings 8 and 9, numeral 11 designates an oiling hole provided within the rotational shaft 7, letters Mb designate a motor stator fixed to the housing 3, letters Ma designate a motor rotor fixed to the rotational shaft 7, numeral 7*a* designates an eccentric pin provided at the end portion of the rotational shaft 7, numeral 10 designates a drive bush fitted between the eccentric pin 7*a* and a boss of the swivel scroll 2, numeral 5 designates an Oldham ring for permitting revolutional swivel motions, while preventing rotational motions, of the swivel scroll 2, numeral 17 designates compression chambers formed between the stationary scroll 1 and the swivel scroll 2, numeral 12 designates a cylindrical flange provided at the outer central portion of the stationary scroll 1, numeral 13 designates a discharge port formed at the cylindrical flange 13 of the stationary scroll 1, numeral 14 designates a discharge valve, numeral 15 designates a discharge chamber, numeral 51 designates a discharge pipe, numeral 52 designates a suction pipe which opens between the bearing 8 of housing and the motor stator Mb, and numeral 16 designates an intermediate pressure chamber formed between the stationary scroll 1 and the discharge cover 4. In this apparatus, two spiral wraps, each projected on the inner surface of an end plate of the stationary scroll 1 and the swivel scroll 2, are engaged with each other and the swivel scroll 2 is driven to make revolutional swivel motions by a motor consisting of the stator Ma and the rotor Mb, thereby a plurality of compression chambers 17 reduce their volume while moving toward the discharge port 13 and compression work is done accompanying therewith.

A scroll type compressor of stationary scroll floating structure wherein the stationary scroll is supported floatingly and urged against the swivel scroll is operated while the tip surface of the spiral wrap makes contact with the bottom land of the opponent scroll. And in order to reduce manufacturing cost and reduce vibrations accompanying with compression, both the stationary scroll and the swivel scroll are made of aluminum alloy. As the scroll type compressor, made of aluminium, of stationary scroll floating structure is short of wear resistance, there is often caused a seizure due to friction at the sliding portion of the spiral wrap tip portion and the opponent scroll bottom land portion.

FIG. 10 is a perspective view of a stationary scroll and a bottom plate to be fitted thereto, which shows one of countermeasures for wear resistance in the prior art. In FIG. 10, numeral 1 designates the stationary scroll, numeral 1*e* designates an end plate of the stationary scroll 1, numeral 1*w* designates a spiral wrap projected on the stationary scroll 1, numeral 6 designates a tip seal fitted to the tip surface of the wrap 1*w* and numeral 18 designates the bottom plate fitted to the inner bottom land of the end plate 1*e*. The bottom plate 18 is made of a thin plate of wear resistant steel. Numeral 22 designates a portion of the bottom plate 18 which the central end portion of the spiral wrap 1*w* passes through and numeral 23 designates a gap portion of the bottom plate 18 which the wrap 1*w* passes through. The swivel scroll 2, to be engaged with the stationary scroll 1, has also a bottom plate of same shape. The above-mentioned prior art is disclosed in the Japanese laid-open utility model application No. Hei 1(1989)-22953.

FIG. 11 is a longitudinal sectional view of a compression mechanism portion of scroll type fluid machine, which shows a state wherein a stationary scroll 1 and a swivel scroll 2, each having said bottom plate, are engaged with each other. In FIG. 11, numeral 1 designates the stationary scroll, numeral 1*e* designates an end plate of the stationary scroll 1, numeral 1*w* designates a spiral wrap of the stationary scroll 1, numeral 18 designates a bottom plate fitted to the bottom land of the stationary scroll 1, numeral 2 designates the swivel scroll, numeral 2*e* designates an end plate of the swivel scroll 2, numeral 2*w* designates a spiral wrap of the swivel scroll 2 and numeral 19 designates a bottom plate fitted to the bottom land of the swivel scroll 2. In this apparatus, when it is operated, the stationary scroll 1 is pushed by the pressure of an intermediate pressure chamber 16, and even while the stationary scroll 1 is urged against the swivel scroll 2, wear of the bottom land is prevented by the wear resistance of each said bottom plate.

FIG. 12 is a transverse sectional view of a compression mechanism portion of scroll type fluid machine, which shows a state wherein a central compression chamber is formed at the approximately final stage of compression. In FIG. 12, numeral 1 designates a stationary scroll, numeral 2 designates a swivel scroll, numeral 13 designates a discharge port, numeral 17*a* designates the central compression chamber and numeral 17*b* designates a pair of outer circumferential compression chambers. Bottom plates are made to the shape of bottom land of each spiral wrap of scrolls shown in the figure.

In FIG. 11, between the tip surface of spiral wrap and the bottom land of opponent scroll, a gap S is formed within the range of work tolerance according to convenience of work process. But as the bottom plate made of steel plate wears in less amount, the sliding face is not conformable and said gap S cannot be reduced during operation. Hence, there is a disadvantage that the performance of compressor is lowered.

Further, in FIG. 12, the pressure of the central compression chamber 17*a* is high as compared with that of the outer circumferential compression chambers 17*b*, so, in the scroll type compressor in the prior art, when the pressure difference between the central compression chamber 17*a* and the outer circumferential compression chambers 17*b* becomes extremely large at the final stage of compression, there may happen a breakage of spiral wraps of the scroll central portion to partition each said compression chamber.

SUMMARY OF THE INVENTION

In order to dissolve above-mentioned shortcomings in the prior art, it is an object of the present invention firstly to make the sliding face conformable so that said gap is reduced even during operation in use of a bottom plate made of steel plate, thereby to enhance the performance of scroll type fluid machine and secondly not to cause a breakage of the spiral wrap central portion even at the final stage of compression in use of a bottom plate made of steel plate.

In order to attain said object, the present invention has following features in a scroll type fluid machine in which a stationary scroll and a swivel scroll, each having an end plate on which a spiral wrap is projected, are engaged with each other:

(1) A thin plate made of steel plate, forming a conformable layer at least on its surface side, is fitted to the bottom land of said respective scroll.

(2) In the scroll type fluid machine mentioned in (1) above, said conformable layer is formed by a molybdenum disulfide layer.

(3) In the scroll type fluid machine mentioned in (1) above, a leakage passage through which a small amount of compressed fluid leaks from a central compression chamber formed by said pair of scrolls to its outer circumferential compression chambers is formed by said thin plate made of steel plate.

(4) In the scroll type fluid machine mentioned in (3) above, said leakage passage is formed by at least one of a concave portion, a stepped portion, a cut-off portion, a hole and a portion where no coating is formed, provided at said thin plate made of steel plate.

BRIEF DESCRIPTION OF THE DRAWINGS

In the accompanying drawings:

FIG. 3 is a view of a bottom plate of a third preferred embodiment according to the present invention, wherein FIG. 3(*a*) is a perspective view and FIG. 3(*b*) is a sectional view taken along line 3*b*—3*b* of FIG. 3(*a*).

FIG. 4 is a perspective view of a bottom plate of a fourth preferred embodiment according to the present invention.

DESCRIPTION OF THE PREFERRED EMBODIMENTS

Figure 1:
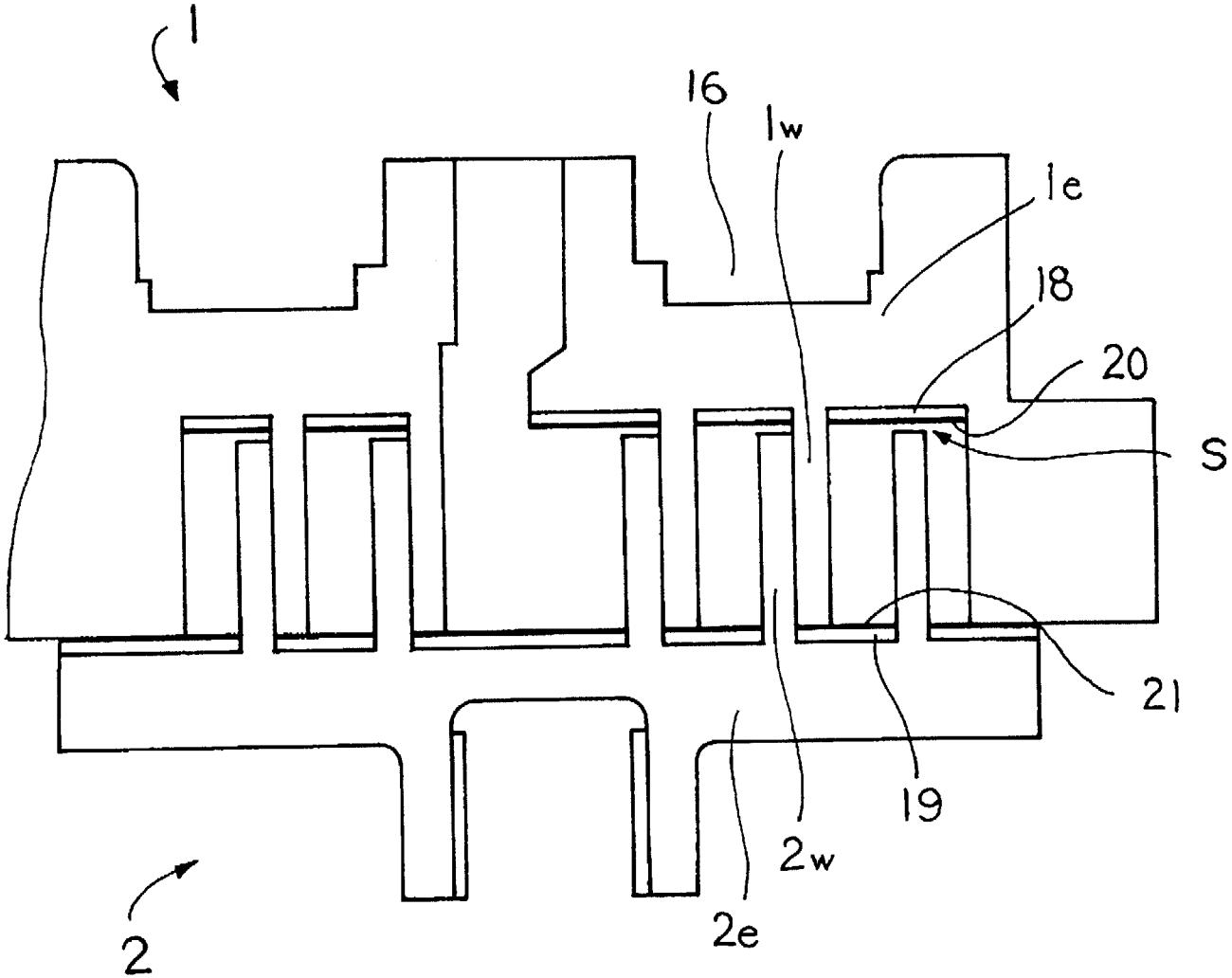
FIG. 1 is a longitudinal sectional view of a compression mechanism portion of scroll type compressor of a first preferred embodiment according to the present invention.
Figure 10:
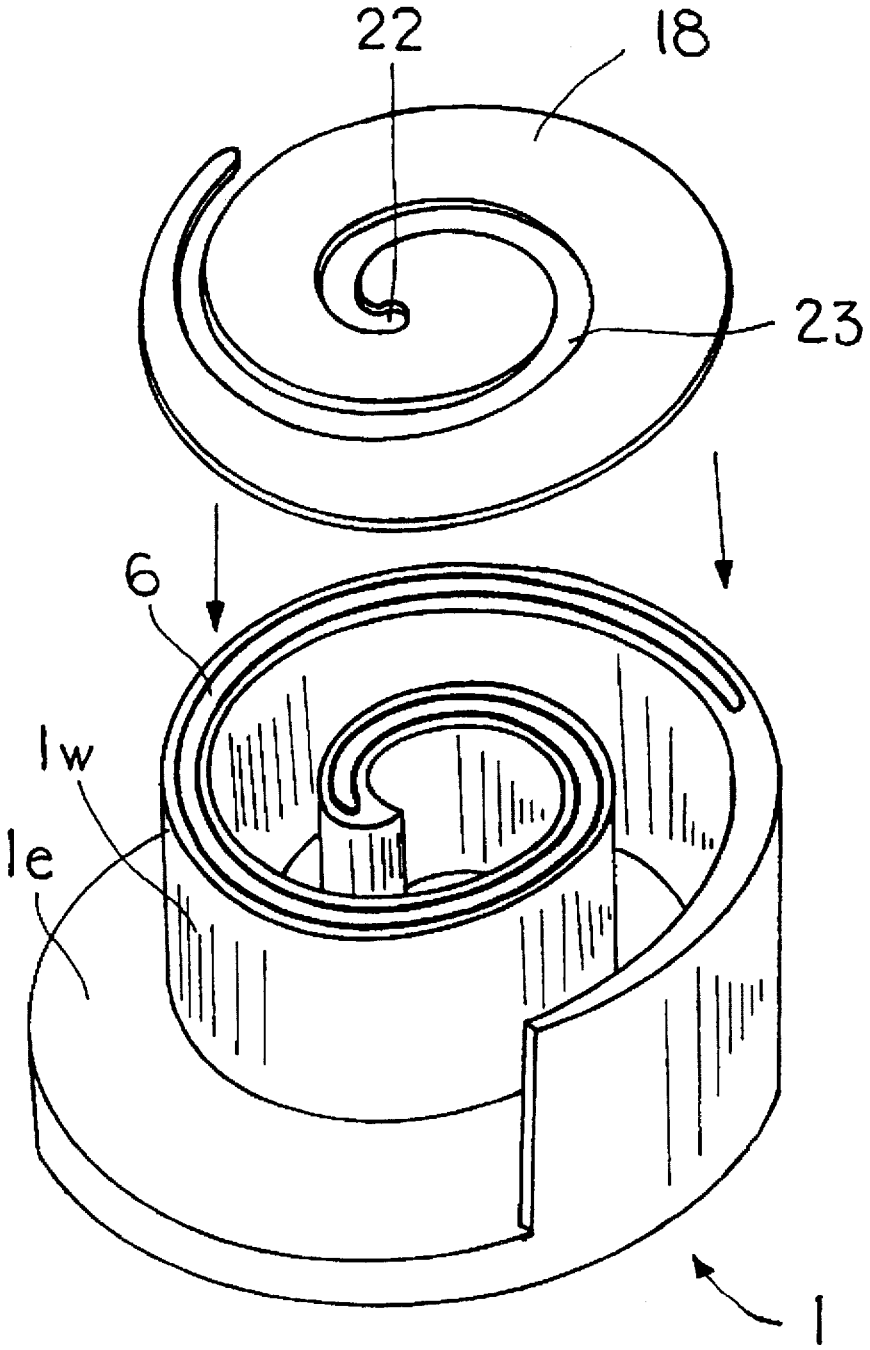
FIG. 10 PRIOR ART
FIG. 10 is a perspective view of a stationary scroll and a bottom plate to be fitted to said stationary scroll of scroll type compressor in the prior art.
Figure 11:
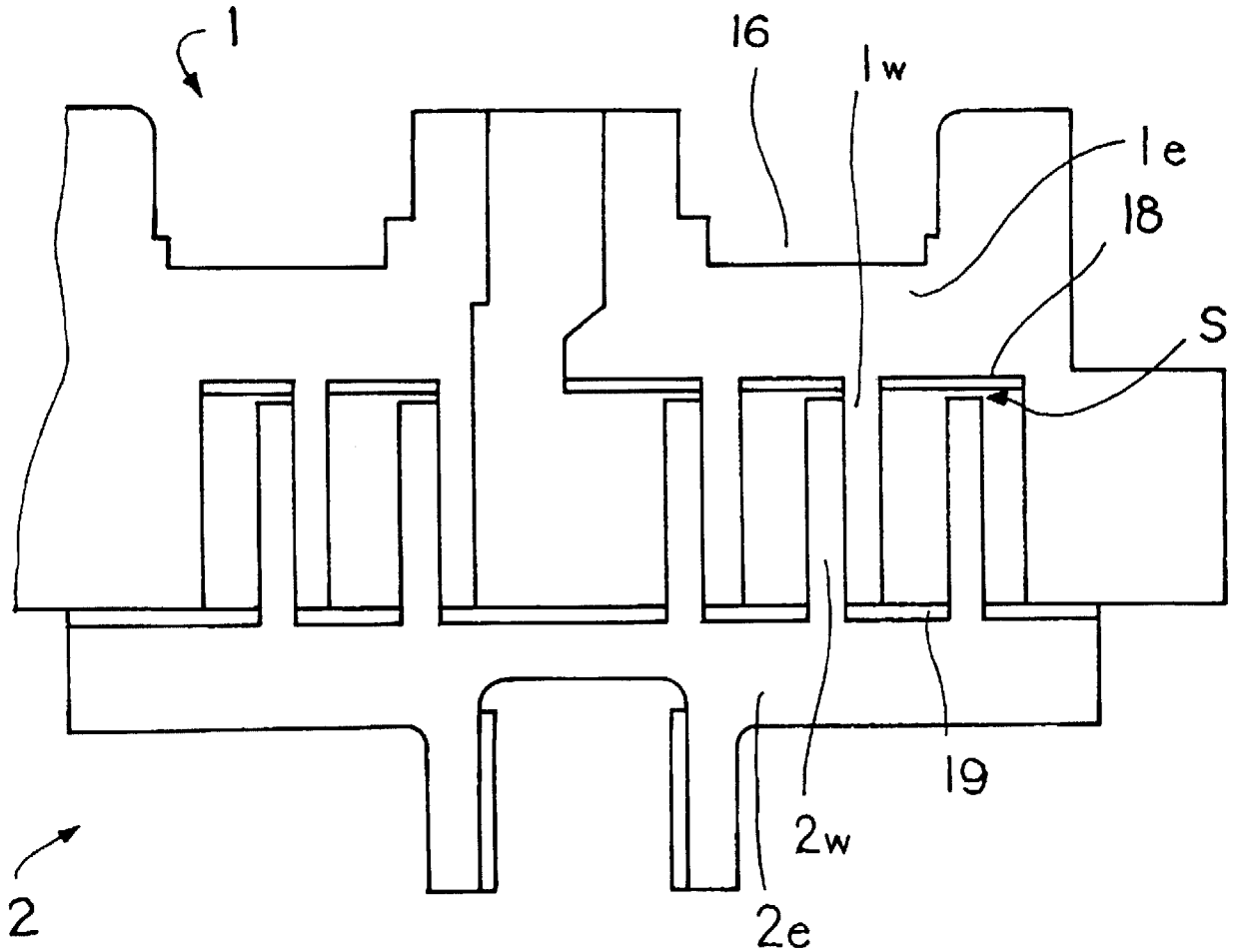
FIG. 11 PRIOR ART
FIG. 11 is a longitudinal sectional view of a compression mechanism portion of scroll type compressor in the prior art.

FIG. 1 is a longitudinal sectional view of a compression mechanism portion of scroll type compressor of a first preferred embodiment according to the present invention. In FIG. 1, numeral 20 designates a conformable layer formed by surface treatment on the sliding surface of a bottom plate 18 of stationary scroll and numeral 21 designates a conformable layer formed, likewise as above, on the sliding surface of a bottom plate 19 of swivel scroll. Structure of other portions than the above is same as the prior art (FIGS. 10 and 11).

If said conformable layer is formed by a molybdenum disulfide layer, being a solid lubricant, effect of seizure prevention can be obtained. If a fluorocarbon resin layer is applied as the conformable layer, same effect can be obtained. If an operation is done by use of this apparatus, the stationary scroll is pushed by pressure of an intermediate pressure chamber 16 and urged against the swivel scroll so that the conformable layers 20, 21 of bottom plates are worn at the spiral wrap tips. Thus, the distance between both scrolls are shortened and the gap S at the spiral wrap tip can be made smaller. Hence, the performance of scroll type compressor is enhanced.

Figure 2:
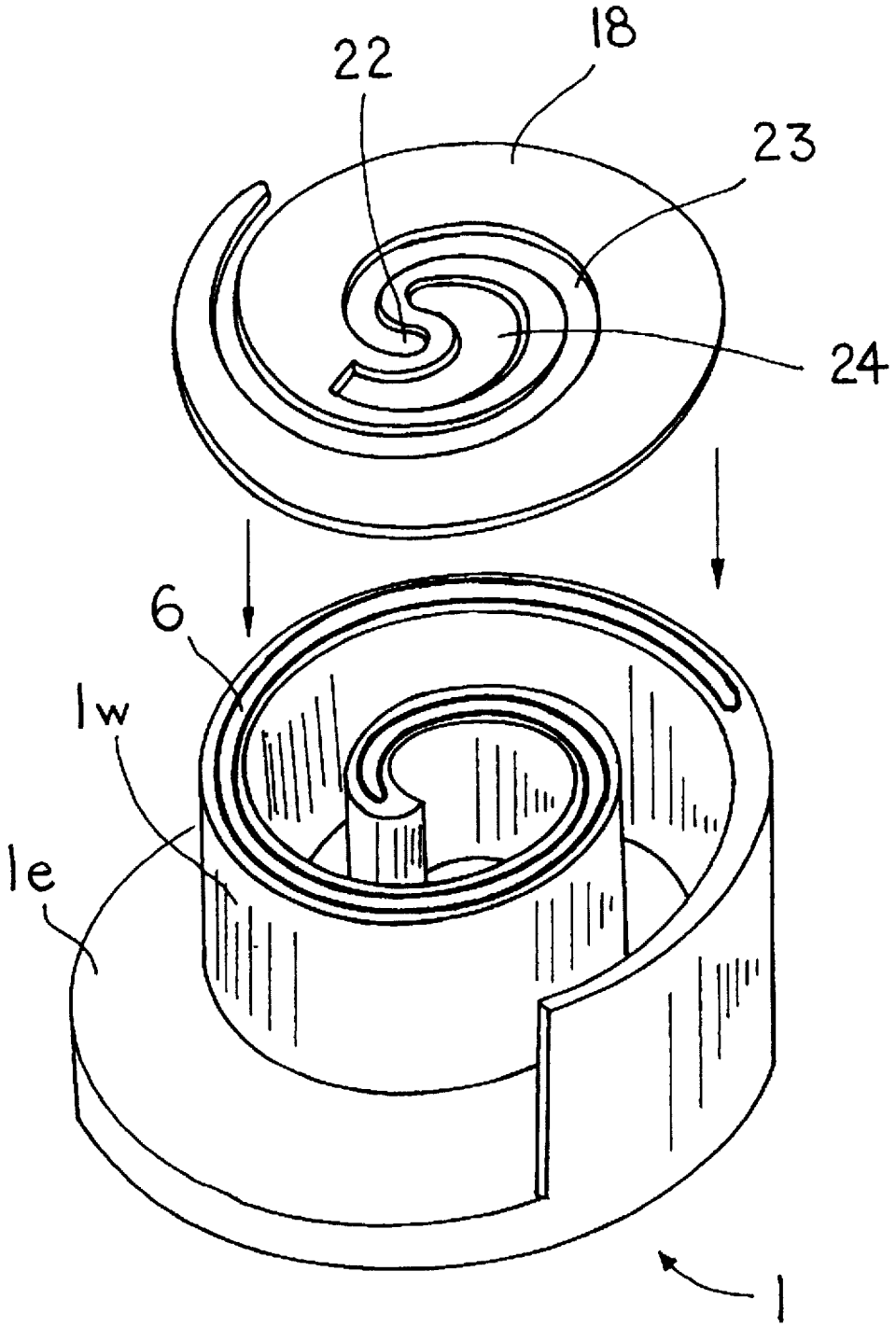
FIG. 2 is a perspective view of a stationary scroll and a bottom plate to be fitted to said stationary scroll of a second preferred embodiment according to the present invention.

FIG. 2 is a perspective view of a stationary scroll 1 and a bottom plate 18 to be fitted to the stationary scroll 1 of a second preferred embodiment according to the present invention. In FIG. 2, numeral 22 designates a portion which the wrap central end portion passes through, numeral 23 designates a gap portion which the wrap passes through, numeral 24 designates a groove provided around the central portion of the bottom plate 18. Said groove 24 is also provided at a bottom plate 19 fitted to an opponent swivel scroll 2 of the stationary scroll 1, but as it is same in shape, illustration is omitted. Other portions than the above are same as the prior art (FIG. 10).

Figure 12:
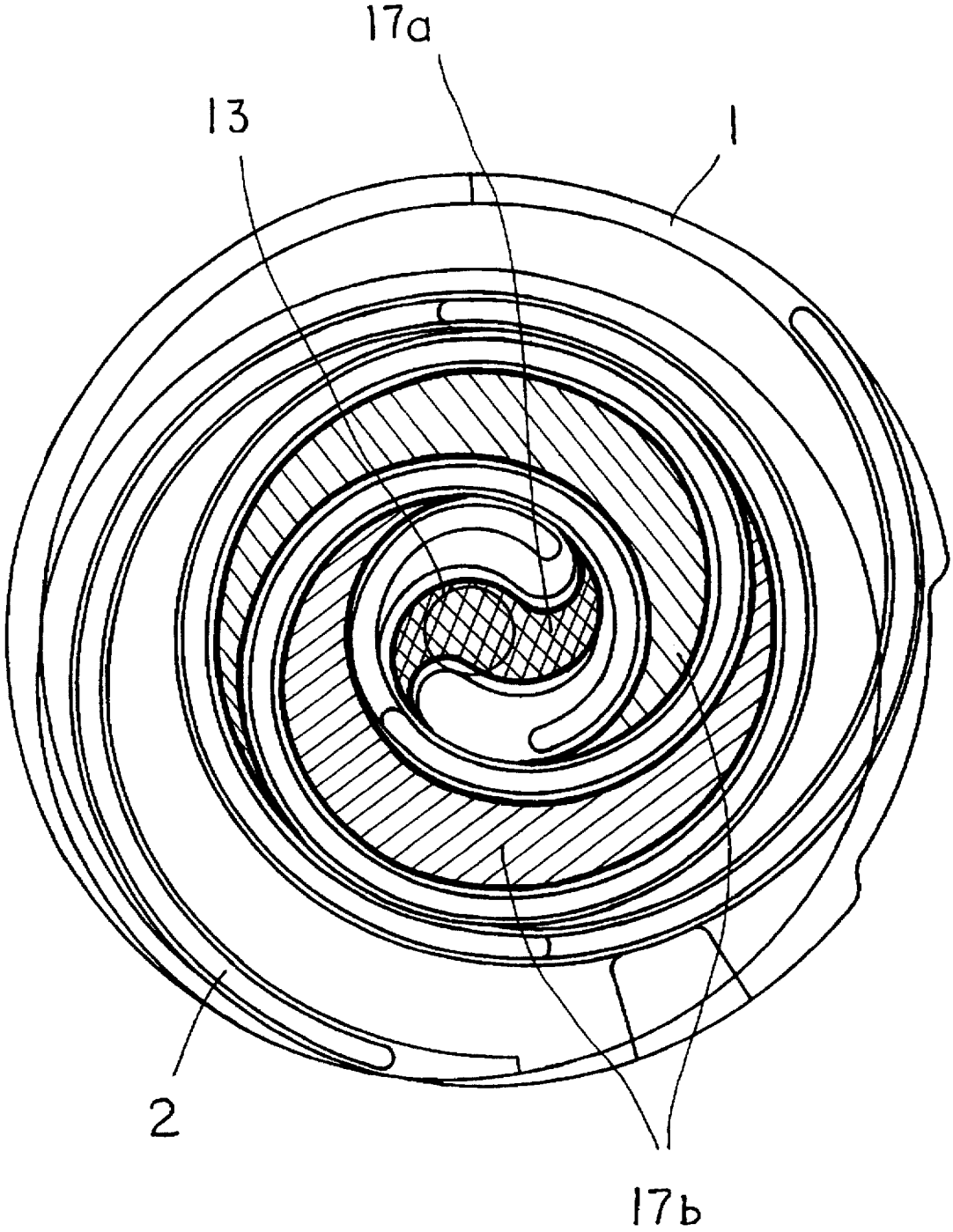
FIG. 12 PRIOR ART
FIG. 12 is a transverse sectional view of a compression mechanism portion of scroll type compressor in the prior art.

Said groove 24 is provided at the position to connect the formed central compression chamber 17*a* (FIG. 12) and one of the pair of outer circumferential compression chambers 17*b* so that both said compression chambers are connected beyond a tip seal 6 of the engaged swivel scroll 2. The other compression chamber of said pair of outer circumferential compression chambers 17*b* and the central compression chamber 17*a* are connected by the groove of same shape of the bottom plate 19 fitted to the swivel scroll 2. By this connection, a small amount of compressed fluid leaks and excess pressure of the central compression chamber is released to the outer circumferential compression chambers, hence the pressure difference between both compression chambers does not become excessive. Thus, force acted on the spiral wraps by the pressure difference is reduced and breakage of the spiral wraps is prevented.

FIG. 3 is a view of a bottom plate 18 of a stationary scroll 1 of a third preferred embodiment according to the present invention, wherein FIG. 3(*a*) is a perspective view and FIG. 3(*b*) is a sectional view taken along line A—A of FIG. 3(*a*). In FIG. 3, numeral 25 designates a stepped portion provided on the central surface of the bottom plate 18 and numeral 26 designates a central thin plate portion formed by said stepped portion 25. Said stepped portion 25 and central thin plate portion 26 are also provided at a bottom plate 19 fitted to a swivel scroll 2. Said stepped portion 25 is also to connect the central compression chamber 17*a* and the outer circumferential compression chambers 17*b*, likewise as the groove of the first preferred embodiment.

FIG. 4 is a perspective view of a bottom plate 18 of a stationary scroll 1 of a fourth preferred embodiment according to the present invention. In this preferred embodiment, a portion designated by numeral 27 of the central portion of the bottom plate 18 is cut off. Said cut-off portion 27 is also provided at a bottom plate 19 fitted to a swivel scroll 2. The central compression chamber 17*a* and the outer circumferential compression chambers 17*b* are connected through said cut-off portion 27.

Figure 5A:
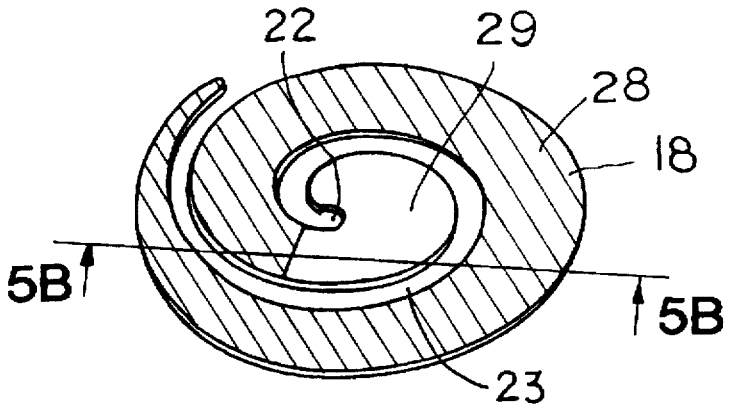
FIG. 5 is a view of a bottom plate of a fifth preferred embodiment according to the present invention, wherein FIG. 5(*a*) is a perspective view and FIG. 5(*b*) is a sectional view taken along line 5*b*—5*b* of FIG. 5(*a*).
Figure 5B:
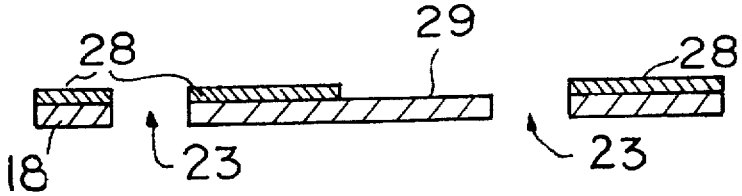

FIG. 5 is a view of a bottom plate 18 of a stationary scroll 1 of a fifth preferred embodiment according to the present invention, wherein FIG. 5(*a*) is a perspective view and FIG. 5(*b*) is a sectional view taken along line B—B of FIG. 5(*a*). In FIG. 5, numeral 28 designates a sliding material coating, such as of Teflon etc., provided on the surface of the bottom plate 18 and numeral 29 designates a portion of the central portion of the bottom plate 18 where no such sliding material coating is formed. Said sliding material coating 28 and portion 29 where no such sliding material coating is formed are also provided at a bottom plate 19 fitted to a swivel scroll 2. In this preferred embodiment, the central compression chamber 17*a* and the outer circumferential compression chambers 17*b* are connected by the portion where no such sliding material coating is formed.

Figure 6A:
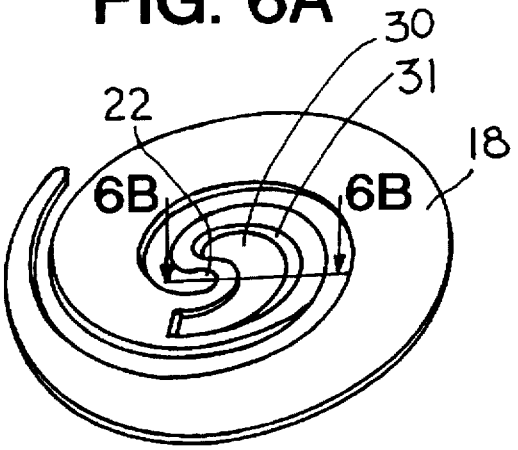
FIG. 6 is a view of a bottom plate of a sixth preferred embodiment according to the present invention, wherein FIG. 6(*a*) is a perspective view and FIG. 6(*b*) is a sectional view taken along line 6*b*—6*b* of FIG. 6(*a*).
Figure 6B:
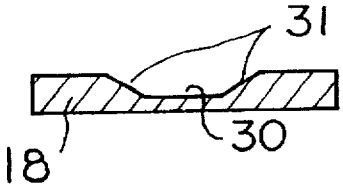

FIG. 6 is a view of a bottom plate 18 of a stationary scroll 1 of a sixth preferred embodiment according to the present invention, wherein FIG. 6(*a*) is a perspective view and FIG. 6(*b*) is a sectional view taken along line C—C of FIG. 6(*a*). In FIG. 6, numeral 30 designates a groove provided at the central portion of the bottom plate 18 and numeral 31 designates an inclined surface portion provided at the periphery of the groove 30. Said groove 30 and inclined surface portion 31 are also provided at a bottom plate 19 fitted to a swivel scroll 2. In this preferred embodiment, the central compression chamber 17*a* and the outer circumferential compression chambers 17*b* are connected by the groove 30. While the compression chambers moves toward the central portion, tip seals 6 (FIG. 10) of the opposingly engaged scrolls slide on the surface of bottom plates. At this time, if the periphery of the groove is rectangular or of similar sharp angle, tip seals wear, hence, in this preferred embodiment, the inclined surface portion 31 is provided at the periphery of the groove 30 so that wearing of tip seals is prevented.

Figure 7A:
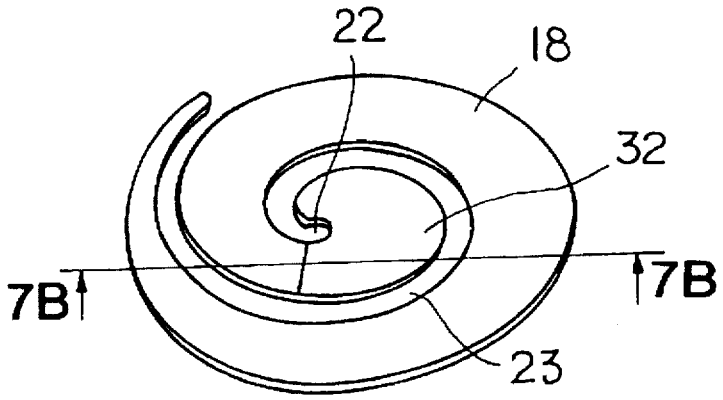
FIG. 7 is a view of a bottom plate of a seventh preferred embodiment according to the present invention, wherein FIG. 7(*a*) is a perspective view and FIG. 7(*b*) is a sectional view taken along line 7*b*—7*b* of FIG. 7(*a*).
Figure 7B:
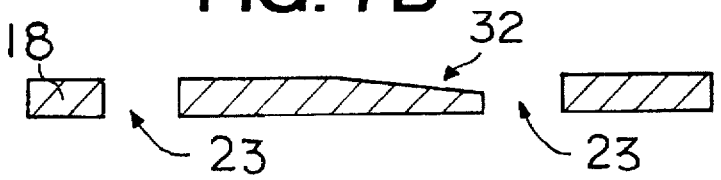

FIG. 7 is a view of a bottom plate 18 of a stationary scroll 1 of a seventh preferred embodiment according to the present invention, wherein FIG. 7(*a*) is a perspective view and FIG. 7(*b*) is a sectional view taken along line D—D of FIG. 7(*a*). In FIG. 7, numeral 32 designates an inclined surface portion provided at the central portion of the bottom plate 18. Said inclined surface portion 32 is also provided at a bottom plate 19 fitted to a swivel scroll 2. In this preferred embodiment, the central compression chamber 17*a* and the outer circumferential compression chambers 17*b* are connected by the portion which is cut off in the process of forming said inclined surface portion 32.

Figure 8A:
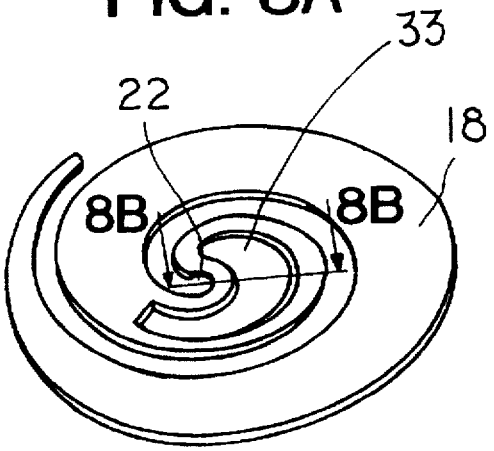
FIG. 8 is a view of a bottom plate of an eighth preferred embodiment according to the present invention, wherein FIG. 8(*a*) is a perspective view and FIG. 8(*b*) is a sectional view taken along line 8*b*—8*b* of FIG. 8(*a*).
Figure 8B:
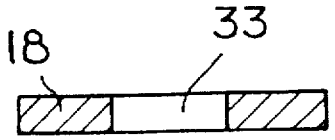
Figure 9:
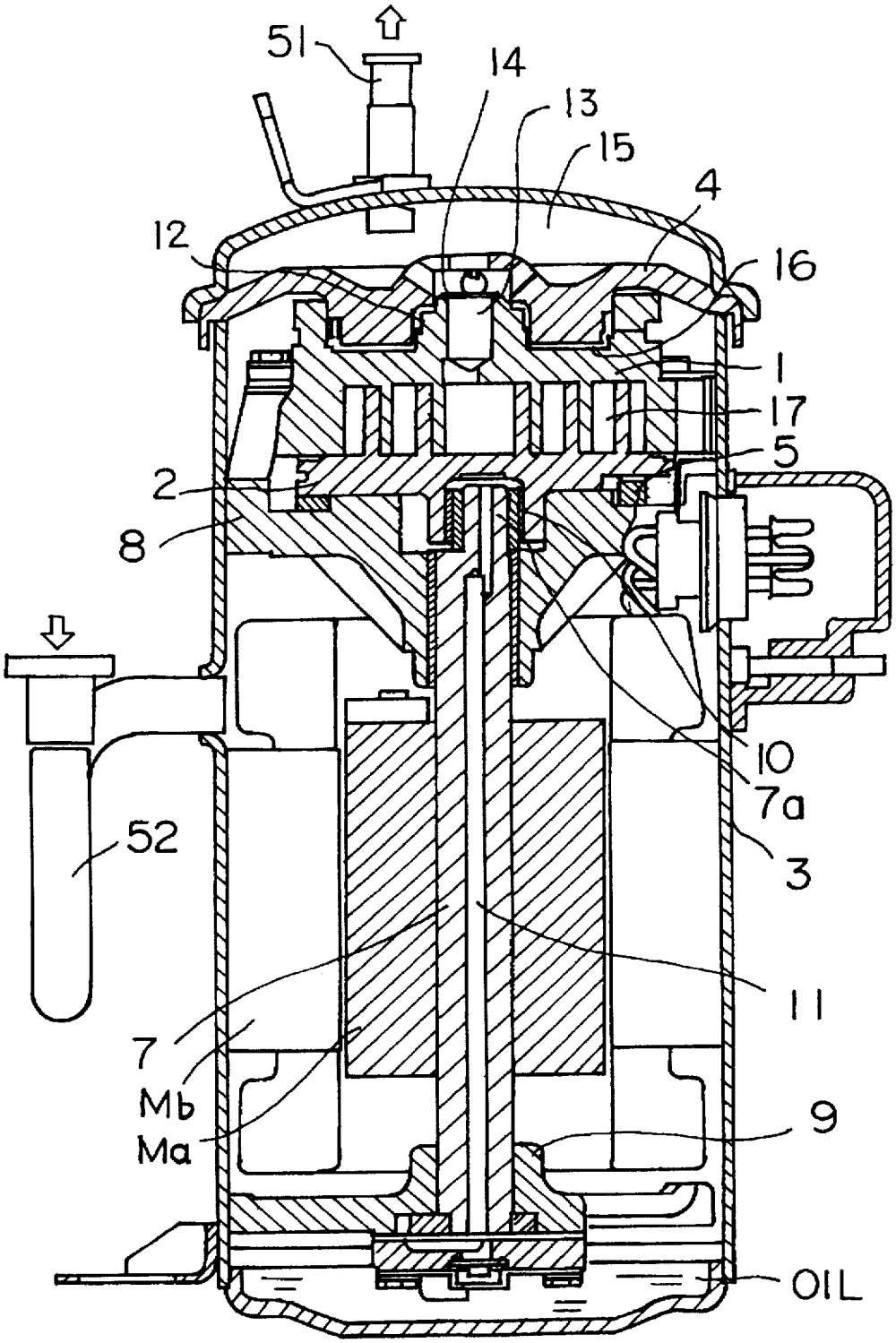
FIG. 9 PRIOR ART
FIG. 9 is a longitudinal sectional view of a scroll type compressor in the prior art.

FIG. 8 is a view of a bottom plate 18 of a stationary scroll 1 of an eighth preferred embodiment according to the present invention, wherein FIG. 8(*a*) is a perspective view and FIG. 8(*b*) is a sectional view taken along line E—E of FIG. 8(*a*). In FIG. 8, numeral 33 designates a pass-through portion formed by punching at the central portion of the bottom plate 18. Said pass-through portion 33 is also provided at a bottom plate 19 fitted to a swivel scroll 2. The pass-through portion 33, together with the inner surface of a scroll end plate, forms a kind of groove, thereby the central compression chamber 17*a* and the outer circumferential compression chambers 17*b* are connected. This preferred embodiment has a feature that the manufacture is facilitated.

The groove, stepped portion, cut-off portion, inclined surface portion, pass-through portion, etc. formed at the respective bottom plate fitted to the pair of opposing scrolls, as mentioned in the above second to eighth preferred embodiments, are all provided at the position to connect he central compression chamber 17*a* formed at the final stage of compression and one of its outer circumferential compression chambers 17*b*. During operation, both said compression chambers are connected beyond the tip seal of the engaged opponent scroll, a small amount of compressed fluid flows therethrough, excess pressure of the central compression chamber is released to the outer circumferential compression chambers and the pressure difference between both compression chambers does not become excessive, hence force acted on the spiral wraps by the pressure difference is reduced and breakage of the spiral wraps can be prevented.

In the scroll type fluid machine according to the present invention, as a conformable layer, especially formed by a molybdenum disulfide layer, is formed on the surface of bottom plate, said conformable layer is worn by the spiral wrap tip portion during operation, the gap at said wrap tip portion is made smaller and the performance of scroll type fluid machine can be enhanced.

Further, a leakage passage through which a small amount of compressed fluid leaks from the central compression chamber formed by a pair of scrolls to its outer circumferential compression chambers is formed by at least one of a concave portion, a stepped portion, a cut-off portion, a hole and a portion where no coating is formed, breakage of the central portion of spiral wraps at the final stage of compression can be prevented.

It is understood that the invention is not confined to the particular construction and arrangement of parts herein illustrated and described but embraces such modified forms thereof as come within the scope of the following claims.

What is claimed is:

1. A scroll fluid machine, comprising:

a stationary scroll comprising a first end plate and a first spiral wrap projecting from one side of said first end plate, said first spiral wrap having a first tip end;

a swivel scroll comprising a second end plate and a second spiral wrap projecting from one side of said second end plate, said second spiral wrap having a second tip end, and said first and second spiral wraps being engaged with each other to engage said stationary and swivel scrolls;

a first thin steel plate on the one side of said first end plate between said first end plate and said second tip end of said second spiral wrap, said first thin steel plate having a surface side facing said second tip end of said second spiral wrap; and a second thin steel plate on the one side of said second end plate between said second end plate and said first tip end of said first spiral wrap, said second thin steel plate having a surface side facing said first tip end of said first spiral wrap;

wherein said first and second thin steel plates comprise conformable layers on said surface sides thereof.

2. The scroll fluid machine of claim 1, wherein said conformable layers comprise a material softer than said first and second tip ends of said first and second spiral wraps so as to be capable of conforming to said first and second tip ends upon engagement of said first and second tip ends with said conformable layers.

3. The scroll fluid machine of claim 1, wherein said conformable layer comprises a lubricating material.

4. The scroll fluid machine of claim 3, wherein said lubricating material comprises molybdenum disulfide.

5. The scroll fluid machine of claim 1, wherein said conformable layers comprise a material selected from the group consisting of molybdenum disulfide and fluorocarbon resin.

6. The scroll fluid machine of claim 1, wherein said first and second spiral wraps define there between a central compression chamber and outer circumferential compression chambers, and wherein at least one of said first and second thin plates comprises a leakage passage interconnecting said central compression chamber and at least one of said outer circumferential chambers.

7. The scroll fluid machine of claim 6, wherein said leakage passage is defined by structure selected from the group consisting of a stepped portion on said at least one of said first and second thin plates, a cut-off portion on said at least one of said first and second thin plates, a hole through said at least one of said first and second thin plates, a concave portion on said at least one of said first and second thin plates, and a portion free from said conformable layers on said at least one of said first and second thin plates.

8. The scroll fluid machine of claim 6, wherein each of said first and second thin plates comprise a leakage passage interconnecting said central compression chamber and at lest one of said outer circumferential chambers.

9. The scroll fluid machine of claim 8, wherein said leakage passages are defined by structure selected from the group consisting of a stepped portion on said first and second thin plates, a cut-off portion on said first and second thin plates, a hole through said first and second thin plates, a concave portion on said first and second thin plates, and a portion free from said conformable layers on said first and second thin plates.

10. The scroll fluid machine of claim 1, wherein each of said first and second thin plates comprises a spiral plate member having a spirally outer portion and a spirally inner portion, and wherein said first and second spiral wraps define there between a central compression chamber and outer circumferential compression chambers, and wherein at least one of said first and second thin plates comprises a leakage passage at said spirally inner portion thereof interconnecting said central compression chamber and at least one of said outer circumferential chambers.

11. The scroll fluid machine of claim 10, wherein said leakage passage is defined by structure selected from the group consisting of a stepped portion on said at least one of said first and second thin plates, a cut-off portion on said at least one of said first and second thin plates, a hole through said at least one of said first and second thin plates, a concave portion on said at least one of said first and second thin plates, and a portion free from said conformable layers on said at least one of said first and second thin plates.

12. The scroll fluid machine of claim 1, wherein:

said first and second spiral wraps define there between a central compression chamber and outer circumferential compression chambers; and one of said first and second thin plates comprises means for fluidly interconnecting said central compression chamber and at least one of said outer circumferential chambers.

* * * * *